US008827768B2

(12) United States Patent
Allen

(10) Patent No.: US 8,827,768 B2
(45) Date of Patent: Sep. 9, 2014

(54) SKATE SHARPENING HOLDER, SKATE BLADE, AND METHOD OF USE

(76) Inventor: Robert H. Allen, Ontario (CA)

( * ) Notice: Subject to any disclaimer, the term of this patent is extended or adjusted under 35 U.S.C. 154(b) by 227 days.

(21) Appl. No.: 13/530,244

(22) Filed: Jun. 22, 2012

(65) Prior Publication Data

US 2013/0344774 A1 Dec. 26, 2013

(51) Int. Cl.
*B24B 41/06* (2012.01)

(52) U.S. Cl.
USPC ..... 451/28; 451/45; 451/365; 451/367; 451/371; 451/383

(58) Field of Classification Search
CPC ..... B24B 3/003; B24B 41/006; B24B 41/06; B24B 9/04; A63C 1/30
USPC ..... 451/28, 45, 365, 367, 383, 371; 280/11.18; 269/16
See application file for complete search history.

(56) References Cited

U.S. PATENT DOCUMENTS

| | | | | | |
|---|---|---|---|---|---|
| 1,243,180 | A | * | 10/1917 | Jensen | 451/437 |
| 1,318,279 | A | * | 10/1919 | Jacobson | 451/371 |
| 1,904,270 | A | * | 4/1933 | Odilon | 280/11.17 |
| 1,945,201 | A | * | 1/1934 | Periolat | 451/321 |
| 2,291,255 | A | * | 7/1942 | Powell | 451/367 |
| 2,438,543 | A | * | 3/1948 | Custin et al. | 451/153 |
| 2,740,241 | A | * | 4/1956 | McCubbin | 451/371 |
| 2,893,179 | A | * | 7/1959 | Sperow | 451/371 |
| 2,938,311 | A | * | 5/1960 | Chambers | 451/371 |
| 3,170,374 | A | * | 2/1965 | Milton | 409/84 |
| 3,376,674 | A | * | 4/1968 | Ernesto | 451/365 |
| 3,597,880 | A | | 8/1971 | Norgiel | |
| 3,800,632 | A | * | 4/1974 | Juranitch | 76/82 |
| 3,881,280 | A | | 5/1975 | Thompson | |
| 4,109,419 | A | | 8/1978 | Broadbent | |
| 4,241,544 | A | | 12/1980 | Hampton | |
| 4,392,332 | A | | 7/1983 | Sakcriska | |
| 4,403,455 | A | * | 9/1983 | Chiasson | 451/303 |
| 5,009,039 | A | | 4/1991 | Lager et al. | |
| 5,897,248 | A | | 4/1999 | Schlueter et al. | |
| 5,938,511 | A | * | 8/1999 | Patterson | 451/377 |
| 6,726,543 | B1 | | 4/2004 | Klosterman | |
| 7,220,161 | B2 | | 5/2007 | Eriksson | |
| 7,549,910 | B2 | * | 6/2009 | Stanley | 451/45 |
| 7,934,978 | B2 | | 5/2011 | Wilson et al. | |
| 8,348,972 | B2 | * | 1/2013 | Soltz et al. | 606/219 |
| 2005/0082773 | A1 | * | 4/2005 | Julien | 280/11.12 |
| 2007/0013152 | A1 | * | 1/2007 | Goldsmith et al. | 280/11.18 |
| 2008/0012248 | A1 | * | 1/2008 | von Detten | 280/11.12 |
| 2008/0100008 | A1 | * | 5/2008 | Wan | 280/11.18 |
| 2013/0092718 | A1 | * | 4/2013 | Soltz et al. | 227/175.1 |

FOREIGN PATENT DOCUMENTS

| | | |
|---|---|---|
| GB | 1362090 | 7/1974 |

* cited by examiner

*Primary Examiner* — George Nguyen
(74) *Attorney, Agent, or Firm* — Clark & Brody

(57) ABSTRACT

A skate sharpening holder includes an anvil plate surface that is adapted to engage with a skate blade so that the skate blade is securely held with respect to the anvil during skate sharpening or contouring. The anvil plate surface can include pins or openings that would engage with respective openings or pins in a skate blade to hold the skate blade in place.

22 Claims, 3 Drawing Sheets

SKATE SHARPENING HOLDER, SKATE BLADE, AND METHOD OF USE

FIELD OF THE INVENTION

The present invention is directed to a skate sharpening holder and skate blade configuration, and particularly to a skate sharpening holder and skate blade that are configured to hold the blade with respect to an anvil plate of the holder for sharpening or contouring.

BACKGROUND ART

A number of skate sharpening fixtures have been developed for skate sharpening machines. These fixtures hold the skate blade in place while a grinding wheel or the like is used to sharpen or contour the skate blade. The orientation of the skate blade with respect to the grinding wheel is critical, and if the blade and wheel are not properly aligned, the blade sharpening or contouring will be compromised.

Prior art fixtures offer control of the blade orientation, see for example, the Wissota and Blademaster fixtures, and U.S. Pat. No. 5,897,248 to Sacriska.

FIG. 1 shows a perspective view of an exemplary skate sharpening fixture, which is designated by the reference numeral 100. The fixture comprises an anvil base 101 which floats on a base plate 103, using springs, bolts and the like. Control knobs 105 are provided for adjusting the orientation of the anvil base 101 with respect to the base plate 103 for sharpening.

An anvil plate 107 is mounted to the anvil base 101 using block 109. The anvil plate 107 provides a surface 108 for one side of the skate blade to rest when the skate edge is being sharpened. A clamp assembly 111 is also provided, which is also mounted to the anvil base 101. The clamp assembly includes a clamp 113, which is designed to be biased against the other side of the skate blade during the sharpening operation.

U.S. Pat. No. 4,392,332 to Sakcriska discloses a skate sharpening holder that uses a number of cams 26 that interface with a cam follower 40 to provide a contour to the blade, see FIG. 1. There is also disclosed a blade centering system that uses dowels 104 that are positioned between the struts of the blade, see FIGS. 1 and 2. FIGS. 12 and 13 show an alternative system to deal with skates with plastic blade holders. The dowel system using dowels 104 cannot work for these types of blade. Instead of using dowels 104, dowels 210 are positioned between the anvil or jaw 69 and the surface 214 of the blade holder. As an alternative, the jaw 68 can be contoured to follow the curve of the blade holder, thus eliminating the need for the dowels 10.

The holder in Sakcriska has a number of problems since it is designed to interface with the skate blade holder in order to center the blade on the holder. However, since there are a number of skate manufacturers, the holders for the skates vary widely amongst different manufacturers. As such, the holder of Sakcriska must use a high number of dowels in order to accommodate the different skates available in the market. This is just not a practical approach for centering skates to a skate sharpening holder. Also, the invention of Sakcriska is predicated on skate blades where the skate blade holders were molded with the skate blades such that the skate blades were not removable and many of the features of Sakcriska are based on these types of skates. However, skate blades now are removable from their holders. As such, a need exists to provide improved skate sharpening holders, which need is fulfilled by the present invention.

SUMMARY OF THE INVENTION

The present invention is an improvement over prior art skate sharpening holders and their methods of use. Another aspect of the invention is an improved skate blade that can be used with the inventive skate sharpening holders to improve the sharpening and/or contouring process for skates.

One aspect of the invention includes a skate sharpening holder that is designed to engage a skate blade or runner (hereinafter called the skate blade) being held by the holder in order that the skate can be accurately sharpened and/or contoured. As part of this engagement, the anvil plate of the holder and the skate blade of the skate are specially configured so that the anvil plate and skate blade are engaged together to hold the skate blade in place on the holder in a secure fashion.

More particularly, the improvement in the skate sharpening holder is the use of a plurality of alignment holes in the support surface of the anvil plate or a plurality of alignment pins extending from the upper surface of the anvil plate. The alignment holes or pins are spaced apart and adapted to engage with respective spaced apart alignment pins or holes on a skate blade. When alignment pins engage the alignment holes, the skate blade is held with respect to the anvil plate for skate sharpening or skate contouring.

Preferably, the anvil plate includes the plurality of alignment pins and the pins in cross section are circular in shape. The holes are also preferably circular in shape. The alignment pins can be aligned in a central zone in the upper surface of the anvil and holes in the skate blade can also be aligned in a middle portion of the skate blade and between the skate blade edge and where the skate blade surface meets the skate blade holder.

The alignment pin length, when extending from the anvil plate, can be equal to or less than a thickness of the skate blade. The alignment pin can also be sized to engage a number of skate blades so that multiple skate blades could be held at one time on the anvil plate.

The invention also includes just the skate blade with the alignment holes or pins. Thus, the skate blade having a length direction extending between front and rear ends of the skate blade would include at least two alignment holes or pins, the alignment holes or pins being spaced apart and aligned along a length direction of the skate blade. The alignment holes or pins are sized to engage with corresponding alignment holes or pins on an anvil plate of a skate sharpening holder. The size of the alignment pins or holes on the skate blade permits a secure engagement with the anvil plate to hold the skate blade in place so that it can be sharpened or contoured without moving with respect to the anvil plate. The skate blade preferably has the spaced-apart alignment holes, which are preferably circular in shape.

The skate blade can be one that has a solid construction such that there are no holes other than that used to align with the anvil plate. In the case where the skate blade may have opening or cutouts for weight savings, the alignment holes would be in addition to these features.

The invention also includes making the alignment pins movable between a first position where at least a portion of the pin extends above the upper surface of the anvil plate so that the alignment pins can engage holes in the skate blade to retain the skate blade for sharpening and/or contouring, and a second position where the pin is positioned below the upper surface so that a skate blade without holes can rest on the upper surface of the anvil plate without interference from the alignment pins. The movable nature of the pins can be accomplished in any known fashion, with a preferred configuration using spring biasing to position the pins in the first position and then using an application of force, e.g., placing a skate blade on the tops of the pins to direct the pins into the second position so that the skate blade can rest on the upper surface of the anvil plate without interference from the pins during sharpening and/or contouring.

Another embodiment of the invention entails using the clamp of the skate sharpening holder with the skate blade to fix the skate blade in place for sharpening or contouring rather than the anvil plate. This embodiment is particularly useful when a skate sharpening holder is used that has the clamp positioned below the anvil plate. With this type of holder, it is easier to rest the skate blade on the upper surface of the clamp, with the clamp having the pins or holes to interface with corresponding pins or holes in the skate blade. In this embodiment, the clamp basically replaces the anvil plate to fix the skate blade for sharpening or contouring.

In another embodiment of the invention, just one pin or hole can be used on the skate blade with one corresponding pin or hole on the anvil plate or clamp. In this embodiment, since there is only one engagement location between the skate blade and either the anvil plate or clamp, the engagement should be one that prevents rotation between the skate blade and either the anvil plate or clamp. One example of this would be to employ a non-circular pin that engages a non-circular hole, e.g., a shape like a triangle, square, rectangle, oval, and the like. While this anti-rotation feature is important when only one pin and hole are used, these non-circular shapes could be employed when there is more than one pin and hole in the skate blade and anvil plate/clamp.

The invention also includes the method of using the skate sharpening holder for skate sharpening or skate contouring by using the uniquely configured skate blades and anvil plate/clamp.

The method can also entail the use an anvil plate/clamp that has one or more pins configured to engage with a weight saving hole or holes in a skate blade. In this method, the anvil plate/clamp can be configured with a pin sized to engage the existing hole in the skate blade. Thus, the inventive skate sharpening holder can be used to work with skate blades that have existing weight saving holes but not the alignment pin(s) or hole(s) described above.

DESCRIPTION OF THE INVENTION

The invention provides significant improvements in the field of skate sharpening and contouring. By using the inventive skate sharpening holder and specially configured skate blades, a skate blade can be securely held or fixed on the holder during sharpening and/or contouring. Using prior art holders, it is often the practice to use the skate blade holder as a guide for the sharpening or contouring operation. However, the holder for one skate of a pair of skates may have a slightly different shape than the holder of the other skate in the pair. In this instance, conducting a contouring or sharpening operation on the one skate will not produce the same shape or contour on the other skate due to the difference between the two skate blade holders of the pair of skates. Even just a subtle difference in the skate blade holders for a pair of skates can result in a significant difference in the sharpened or contoured skate. Put another way, the pair of skates do not have the same contour and edge profile and this then compromises skating, whether it be figure skating, speed skating, hockey, or the like.

The present invention overcomes this problem by fixedly linking the skate blade to the anvil of the holder. With this link being consistent for each skate blade of the pair of skates, the edge profile or contour will be essentially the same for each skate and the skater's performance will not suffer from differences between the skates as is the case when employing the prior art techniques. The fixing of the skate blade between the clamp and anvil plate of a skate sharpening holder allows for a repeatable operation in terms of sharpening or contouring. This means that a pair of skate blades can be sharpened or contoured in a repeatable manner and differences between the two blades after sharpening or contouring are minimized and skating performance is improved.

Another advantage is that the invention is independent of the shape of the holder itself As noted above, skate manufacturers make a myriad of differently shaped holders. This means that for each differently-shaped holder for a pair of skates, the skate is held on the skate sharpening holder in a slightly different way and these differences between pairs of skates can also affect the sharpening or contouring operation.

Figure 2:
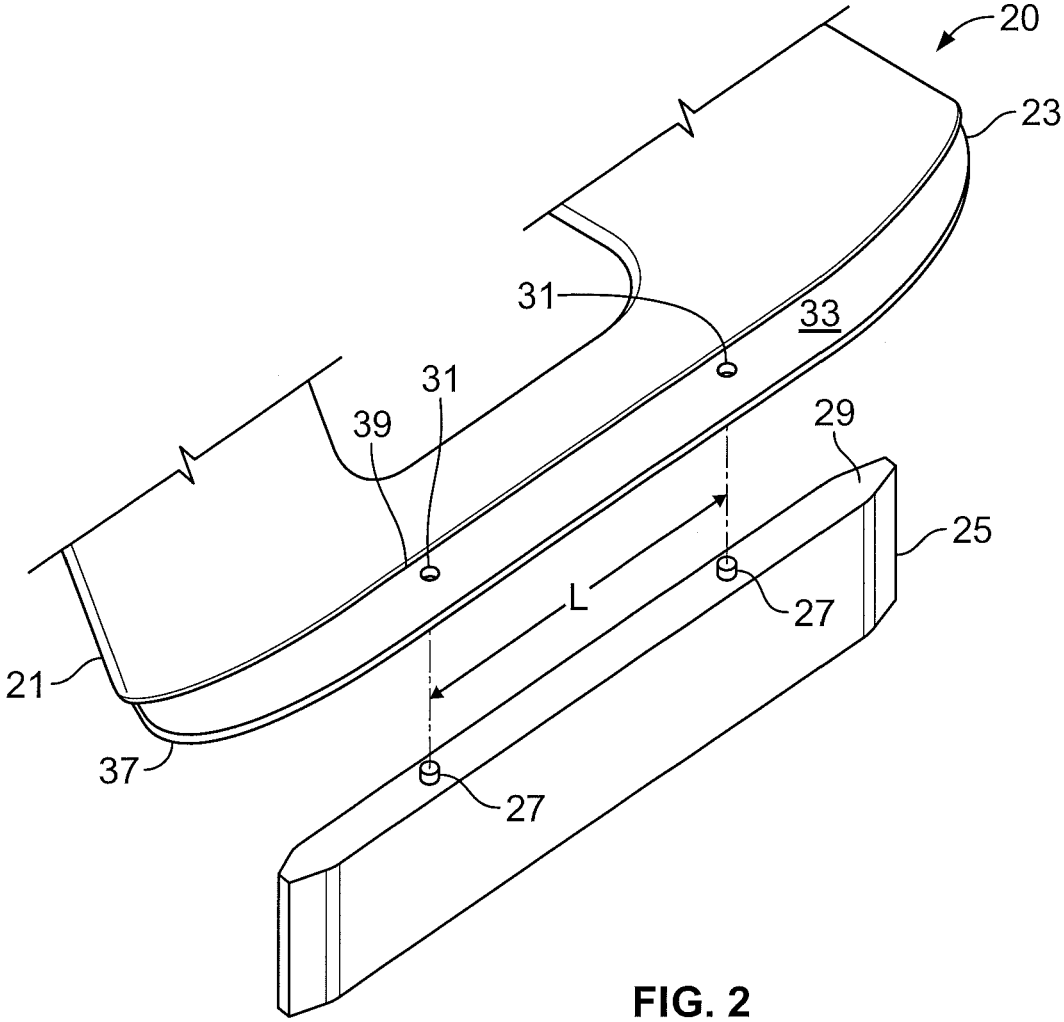
FIG. 2 is a perspective view of one embodiment of the invention showing a part of the skate sharpening holder and a skate blade.
Figure 3A:
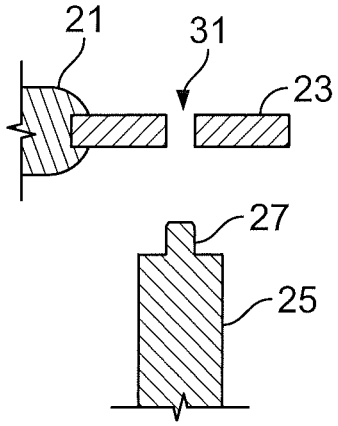
FIG. 3A shows a partial sectional view of the anvil of the skate sharpening holder and a skate blade prior to engagement.
Figure 3B:
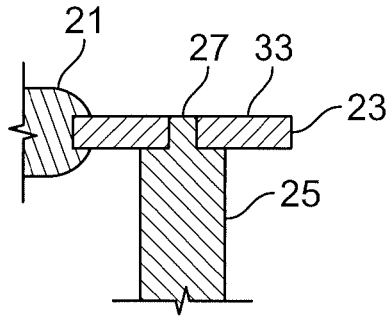
FIG. 3B shows a partial sectional view of the anvil of the skate sharpening holder and a skate blade in engagement.

One embodiment of the invention is shown in FIGS. 2-3B. A skate blade holder-skate blade combination 20 is shown with a skate blade 23 mounted thereto. The other parts of the skate like the boot, etc. are not shown since these features are well known to those of skill in the art.

Figure 1:
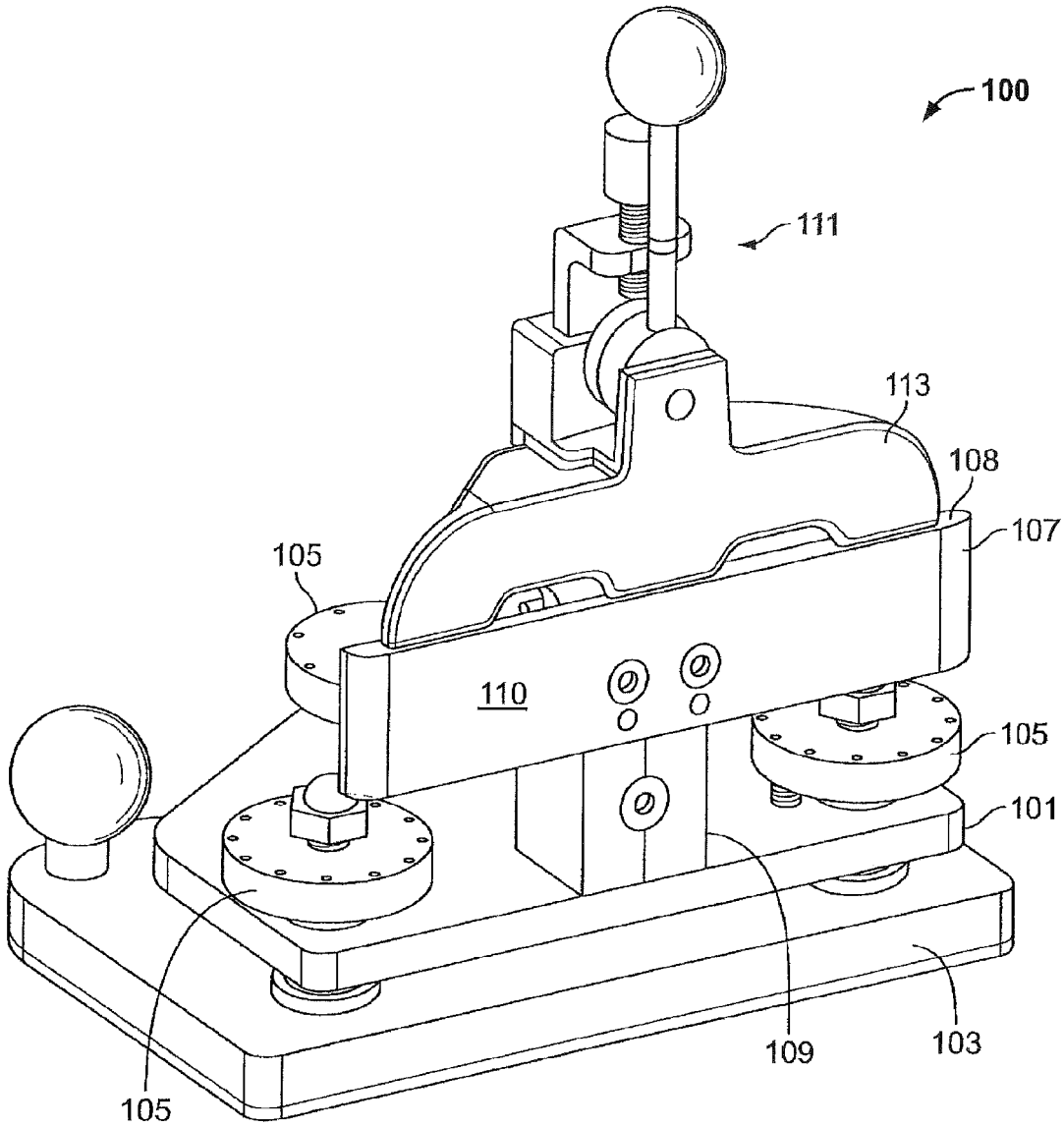
FIG. 1 PRIOR ART
FIG. 1 is a perspective view of a prior art skate sharpening holder.

Also shown is an 107 of a skate sharpening holder such as the one depicted in FIG. 1. The other aspects of the skate sharpening holder can be seen in FIG. 1 or are generally known so that further description thereof is not necessary for understanding of the invention. It should be understood that the anvil plate 25 is representative of any anvil plate or other structure used in a skate sharpening holder that provides a lower support for a skate blade in a holder, when the skate blade is clamped down onto the anvil plate for sharpening or contouring.

One embodiment of the invention has the anvil plate using a pair of alignment pins 27 (pins hereafter) that extend from a surface 29 of the anvil plate 25. Preferably, the pins are positioned in a center portion of the surface 29 and spaced apart along the longitudinal axis or long length of the anvil plate. However, the pines could be positioned nearer one or the other edges of the surface 29. Alternatively, one pin could be near one edge of the anvil plate with the other pin closer to the other edge.

The skate blade 23 is shown with a pair of alignment holes 31 (holes hereinafter) in the skate blade that are complementary to the pins 27 in the skate blade 23. The pins 27 and holes 31 are spaced apart using the same dimension L so that pins 27 can engage the holes 31 and the skate blade can lay flat on the surface 29 of the anvil plate 25, see FIGS. 3A and 3B.

While a pair of pins are shown, more than two pins can be used. For example, three pins in a row or three pins with one of the three pins positioned out of the row could be used. In addition and while the holes are shown as circular in shape and the pins are shown as being cylindrical in shape, the pins and holes could have other shapes that engage each other. Examples include ovals, triangles, squares, rectangles, and the like.

It should also be understood that the size of the holes 31 in the skate blade are small so as not to disrupt the skate blade design or balance. The holes are not the type of large openings or cutouts that may be found in skate blades that are intended for weight savings. Typically, the holes are spaced apart around 3 inches and are ⅛ inch in diameter. Of course, other spacings and size holes can be employed without departing from the spirit of the invention.

The spacing of the holes 31 and pins 27 is precisely defined so that the pins 27 of the anvil can engage the holes 31 of the skate blade regardless of the skate blade manufacturer, which may use different shaped blades and/holders. The holes 31 can be formed in the skate blade with the precise spacing regardless of the skate blade holder configuration. Thus, skate blades of any manufacturer can include the precisely-spaced apart holes 31 in their skate blades and skate blades from any number of manufacturers can be used on an anvil plate having the correspondingly spaced apart pins 27. Thus, a skate sharpener can use the skate sharpening holder with the anvil plate 25 to sharpen or contour any skate from any manufacturer as long as the skate blade has the corresponding spaced apart holes.

The ability to have the spacing and hole size be consistent amongst skate manufacturers also creates a market for replacement blades. Since blades wear out during use, the skate itself is not replaced, just the blades. Thus, a skate user can buy replacement blades with the spaced apart pins or holes so that the skates can still be sharpened or contoured on a skate sharpening holder having the matching pins or holes on the anvil plate.

The pins 27 are sized so that they do not extend past the holes 31 in the skate blade (equal to or less than the thickness of the skate blade) so as not to interfere with clamping of the skate blade in the skate sharpening holder. If the pins are too high, the clamp will not securely engage the upper face of the skate blade when on the anvil plate. The pins 27 can be sized so that they terminate even with the surface 33 of the skate blade or just below the surface.

Figure 4:
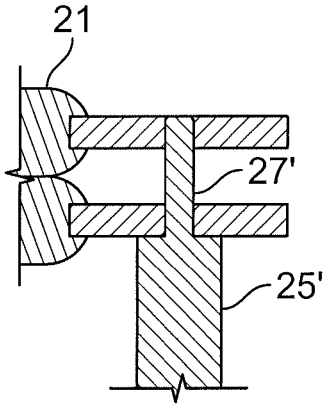
FIG. 4 shows an alternative embodiment where the anvil is designed to accommodate multiple skate blade.

FIG. 4 shows an alternative embodiment, wherein the pins 27' of anvils 25' are sized so that they can extend through multiple skate blades 23. This would allow sharpening or contouring of a number of skate blades at one time. In this embodiment, the skate sharpening holder could be equipped with two anvil plates, one with the pins 27 and the other with the pins 27' so that the appropriate anvil could be selected when using one or multiple skates.

Figure 5:
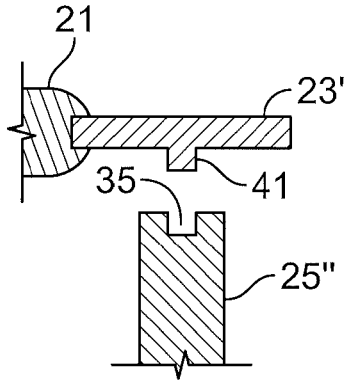
FIG. 5 shows an alternative embodiment to the embodiment of FIG. 2.

FIG. 5 shows another embodiment of the invention. In this embodiment, the anvil plate 25" has spaced apart holes 35. The holes are sized to receive pins 41 extending from the skate blade 23'. As with the embodiments described above, the pins 41 and holes 35 can have different shapes, providing that they are sized for tight engagement to keep the skate blade in place.

Figure 6A:
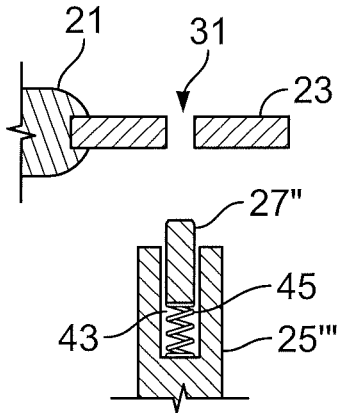
FIG. 6A shows yet another embodiment of the invention.
Figure 6B:
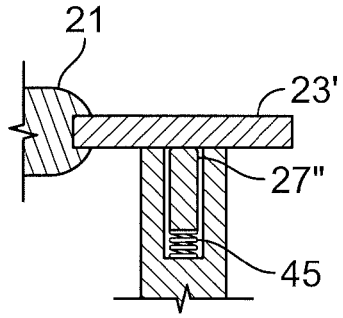
FIG. 6B shows the embodiment of FIG. 6A in use with a prior art skate blade.

Referring now to FIGS. 6A and 6B, a further embodiment of the invention involves making the pins 27 shown in FIG. 2 movable with respect to the anvil plate 25. In this mode, the pins could be preferably spring loaded so that they are in an at rest state as shown in FIG. 2, i.e., extending above the top surface 29 of the anvil plate 25.

The spring loaded embodiment is depicted in FIGS. 6A and 6B, wherein FIG. 6A shows an anvil plate 25'" with a movable pin 27'. The pin rests in a bore 43 in the anvil plate 25'" A spring 45 is located in the bore, with the spring biasing the pin 27' in the extended state, i.e., at least a portion of the pin is above the top surface of the anvil plate. In this configuration, the pins 27' of the anvil plate 25'" can be used in the same manner as the fixed pins shown in FIG. 2 for sharpening and/or contouring.

The advantage of having movable pins is the ability to use the anvil plate 25'" with a skate blade that does not have any holes 31, see FIG. 2. Upon application of a force to the top of the pin 27', the pin 27' would move against the bias of the spring 45 and recede into the bore 43 in the anvil plate 25'". Having movable pins of this nature would allow the anvil plate 25'" to be used with a skate blade 23' that would not have any openings or other alignment features, see FIG. 6B that shows the skate blade 23. Such an anvil plate configuration would allow the skate sharpening holder to have a dual function, i.e., the ability to sharpen or contour skate blades having the holes 31 or skate blades without any openings.

Holding the spring 45 and pin in the bore 43 of the anvil plate 25' can be done in any number of ways. The spring 45 can be secured in the bottom of the bore 43 and the pin 27' secured to the spring. Alternatively, the pin 27' could have a flange at its lower end engage a ring or other structure associated with the bore to keep the pin in place and the pin and spring could be separate. In fact, any arrangement, including those that may not use springs, that allows the pin to be positioned above the top surface of the anvil plate to engage openings in a skate blade and be positioned below the upper surface of the anvil plate to permit a skate blade to rest on the top surface of the anvil plate without interference from the pins can be employed as part of the invention. Because the pin can be made movable in any number of ways, FIGS. 6A and 6B are drawn schematically to show the pin and spring but without the detail of how the pin and spring are held in place. This detail is not necessary for understanding of the drawings or the invention.

Another embodiment of the invention could have the clamp of the skate blade holder have pins or holes that are located to engage the corresponding pins or holes of the skate blade. This embodiment is less preferred then the earlier described embodiment. In the earlier described embodiment, the skate blade with holes that just rest on the anvil plate with the pins and the clamp moved in place. Having the clamp have to engage the skate blade with pins and holes requires the blade to either be held up to that pins in the clamp engage holes in the blade or the blade has to be aligned precisely when resting on the anvil plate so that when the clamp is lowered, pins on the clamp engage the holes in the blade.

Going back to the embodiment where the blade has spaced apart holes, the holes 31 in the skate blade are spaced apart in a midsection or middle portion of the skate blade when considering its length. As shown in the drawings, the holes 31 are slightly closer to the edge 39 where the skate blade surface 33 meets with the skate blade holder 21. However, the holes 31 could also be located more central in the blade when considering the width between the holder and blade edge, or even closer to the edge 37. In any event, the location of the holes 31 are such that there is enough space for the skate blade to rest on the surface 29 of the anvil plate 25 without the blade holder 21 contacting the surface 29 and preventing the skate blade from laying flat on the surface 29 of the anvil plate 25. The location of the holes 31 also allows enough of the skate blade edge 37 to extend beyond the anvil plate, see FIG. 3*b*, that the blade 23 and edge 37 can be worked on. Also, positioning the holes 31 to close to the edge 37 may weaken the blade edge and positioning the holes 31 too close to the holder 21 can prevent the proper engagement of the skate blade 23 with the anvil plate.

Replacement blades that would be used for skate blade holders can also include the holes or pins in the skate blade so that when the skate blades need to be replaced, the replacement skate blade can be used with the anvil plate of the inventive skate sharpening holder for sharpening or contouring.

It should be understood that the holes or opening are preferably in a central zone of the skate blade and are a closed type, i.e. surrounded by the blade metal with a continuous outer edge of the hole, i.e., forming a closed circle. They are not considered to be openings or a configuration of the skate blade that may function for attachment of the skate blade to a blade holder. The holes in the metal of the blade with their continuous outer edge are not cutouts that may be formed along a side of the blade for weight savings or for holder attachment purposes.

The invention can also be used with an existing skate blade that may have one or more holes in the blade for weight reduction. In this embodiment, the anvil plate could be configured with one or more pins that would be sized to engage the existing hole in a skate blade. For example, certain skate blades have non circular holes, e.g., a vapor ice skate. To accommodate these blades, the anvil plate could have a pin that is sized to engage one or more of the openings in the skate blade. In this way, an existing skate blade can be used with the inventive skate sharpening holder. If the weight reduction hole in the skate blade is bigger than a width of the anvil plate, the pin in the anvil plate would just be appropriately sized on the anvil plate to achieve the necessary engagement.

While the skate sharpening holder is shown with the anvil plate in a lower position and the clamp positioned above so that the clamp would move downward to the anvil plate, the invention can be utilized with other skate sharpening holders, wherein the anvil plate is positioned in a horizontal orientation rather than the vertical one shown in FIG. 1 (the skate blade is vertical for sharpening instead of horizontal.)

In addition, a skate sharpening holder could also have the clamp positioned below the anvil plate, with the clamp moving in an upward direction to fix the skate blade between the anvil plate and the clamp. In this embodiment, it is possible to have the clamp include the one or more pins or holes instead of the anvil plate, with the skate blade having the other of the pins or holes. When using this type of holder, the skate blade could rest on the upper surface of the clamp and the clamp would be raised so that the skate blade is raised and fixed between the clamp and anvil plate for skate sharpening and/or contouring. For this embodiment, the anvil plate shown in the drawings could be interpreted as a clamp with either the pins or holes for securing or fixing the skate blade. Of course, if the skate sharpening holder employs a clamp positioned beneath the anvil plate, the anvil plate could still be configured as described above. In other words, the anvil plate would just be positioned upside down from the FIG. 1 position, with the pins extending from a lower surface thereof or holes extending into the lower surface.

As such, an invention has been disclosed in terms of preferred embodiments thereof which fulfills each and every one of the objects of the present invention as set forth above and provides a new and improved skate sharpening holder as well as skate blades for use therein.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. In a skate sharpening holder having an anvil plate and a clamping assembly to hold a skate blade between a surface of a clamp of the clamping assembly and a surface of the anvil plate for skate sharpening and/or skate contouring, the improvement comprising a plurality of alignment holes in a surface of the anvil plate or clamp or a plurality of alignment pins extending from the surface of the anvil plate or clamp, the alignment pins or holes spaced apart and adapted to engage with respective alignment holes or pins of the skate blade so that when the alignment pins engage the alignment holes, the skate blade is held with respect to the anvil plate or clamp for skate sharpening or skate contouring.

2. The holder of claim 1, wherein the anvil plate includes the plurality of alignment pins.

3. The holder of claim 2, wherein the alignment pins have a circular cross sectional shape.

4. The holder of claim 2, wherein the alignment pins are aligned along a longitudinal axis of the upper surface of the anvil plate.

5. The holder of claim 2, wherein a length of the alignment pins is equal to or less than a thickness of the skate blade.

6. The holder of claim 2, wherein a length of the alignment pins is greater than a thickness of the skate blade but equal to or less than a thickness of two or more skate blades.

7. The holder of claim 2, wherein the alignment pins are movable between a first position where at least a portion of the pin extends from a surface of the anvil plate or clamp so that the alignment pins can engage holes in the skate blade and a second position where the pin is positioned from the surface of the anvil plate or clamp so that a skate blade without holes can rest on the surface of the anvil plate or clamp without interference from the alignment pins.

8. The holder of claim 7, wherein the alignment pins are spring biased for movement between the first and second positions.

9. In a skate blade having a length direction extending between front and rear ends of the skate blade and adapted to be held in a skate blade holder, the improvement comprising at least two alignment holes or pins, the at least two alignment holes or pins being spaced apart and aligned along the length direction of the skate blade, the at least two alignment holes or pins sized to engage with corresponding alignment holes or pins on an anvil plate or clamp of a skate sharpening holder, the alignment pins or holes on the skate blade permitting a secure engagement with the anvil plate or clamp to hold the skate blade in place so that it can be sharpened or contoured without moving with respect to the anvil plate.

10. The skate blade of claim 9, wherein the skate blade has spaced-apart alignment holes.

11. The skate blade of claim 10, wherein the spaced-apart alignment holes are circular in shape.

12. The skate blade of claim 9, wherein the skate blade comprises:

a solid construction with no openings other than the alignment holes; or a construction having one or more openings in the skate blade for weight savings, the alignment holes being in addition to any weight saving openings.

13. The skate blade of claim 12, wherein the skate blade has spaced apart alignment holes.

14. The skate blade of claim 13, wherein the spaced apart alignment holes are circular in shape.

15. In a method of sharpening or contouring a skate blade using a skate sharpening holder having an anvil plate and clamp to hold the skate blade therebetween, the improvement comprising securing the skate blade between the clamp and anvil plate using spaced apart alignment pins or holes on a surface of the anvil plate or clamp and respective spaced apart holes or pins in the skate blade for skate sharpening or skate contouring.

16. The method of claim 15, wherein the spaced apart pins are on an upper surface of the anvil plate to engage spaced apart holes in the skate blade.

17. The method of claim 15, wherein the spaced apart holes in the skate blade are circular in shape and/or the spaced apart pins on the anvil plate or clamp have a circular cross section.

18. In a skate sharpening holder having an anvil plate and a clamping assembly to hold a skate blade between a surface of a clamp of the clamping assembly and a surface of the anvil plate for skate sharpening and/or skate contouring, the improvement comprising at least one alignment hole in a surface of the anvil plate or clamp or at least one alignment pin extending from the surface of the anvil plate or clamp, the at least one alignment pin or hole shaped to engage with a hole or pin of the skate blade so that the skate blade cannot rotate with respect to the anvil plate or clamp and the skate blade is held with respect to the anvil plate or clamp for skate sharpening or skate contouring.

19. In a method of sharpening or contouring a skate blade using a skate sharpening holder having an anvil plate and clamp to hold the skate blade therebetween, the improvement comprising securing the skate blade between the clamp and anvil plate using at least one alignment pin or hole on a surface of the anvil plate or clamp and at least one alignment hole or pin in the skate blade, wherein the at least one alignment pin or hole on the anvil plate or clamp and the at least one alignment hole or pin on the skate blade are shaped so that the skate blade cannot rotate when secured between the clamp and the anvil plate.

20. The method of claim 19, wherein the clamp or anvil plate has the at least one alignment pin and the skate blade has the at least one hole.

21. The method of claim 20, wherein the at least one hole on the skate blade is in addition to one or more weight saving holes on the skate blade.

22. The method of claim 20, wherein the at least one hole on the skate blade is a weight savings hole.

* * * * *